US009849396B2

(12) United States Patent
Kimura

(10) Patent No.: US 9,849,396 B2
(45) Date of Patent: Dec. 26, 2017

(54) SHOULDER JOINT STRUCTURE OF DOLL BODY

(71) Applicant: BANDAI CO., LTD., Tokyo (JP)

(72) Inventor: Satoshi Kimura, Tokyo (JP)

(73) Assignee: BANDAI CO., LTD., Tokyo (JP)

( * ) Notice: Subject to any disclaimer, the term of this patent is extended or adjusted under 35 U.S.C. 154(b) by 13 days.

(21) Appl. No.: 15/274,285

(22) Filed: Sep. 23, 2016

(65) Prior Publication Data

US 2017/0113153 A1 Apr. 27, 2017

(30) Foreign Application Priority Data

Oct. 26, 2015 (JP) ..... 2015-209680

(51) Int. Cl.
*A63H 3/46* (2006.01)
*A63H 3/48* (2006.01)

(52) U.S. Cl.
CPC ..... *A63H 3/46* (2013.01); *A63H 3/48* (2013.01)

(58) Field of Classification Search
CPC ... A63H 3/00; A63H 3/20; A63H 3/36; A63H 3/46
See application file for complete search history.

(56) References Cited

U.S. PATENT DOCUMENTS 4,274,224 A * 6/1981 Pugh ..... A63H 3/16 446/375
4,279,099 A * 7/1981 Dyer ..... A63H 3/20 446/330
4,596,532 A * 6/1986 Cook ..... A63H 3/20 446/330
4,673,374 A * 6/1987 Kelley ..... A63H 3/46 446/383

(Continued)

FOREIGN PATENT DOCUMENTS

CN 203861915 U 10/2014
JP 2000-140449 A 5/2000

(Continued)

OTHER PUBLICATIONS

Japan Patent Office, Office Action for Application No. 2015-209680, dated Jul. 13, 2016, 6 pages, Japan.

(Continued)

*Primary Examiner* — Gene Kim
*Assistant Examiner* — Alyssa Hylinski
(74) *Attorney, Agent, or Firm* — Alston & Bird LLP

(57) ABSTRACT

A shoulder joint structure of a doll body includes a first joint member housed inside a trunk of the doll body and connected to the trunk, a second joint member housed inside the trunk and connected to the first joint member, and a third joint member connected to the second joint member and an arm of the doll body through an opening formed in a shoulder of the trunk. The first joint member is rotatable (Continued)

about a first connecting portion between the trunk and the first joint member, so as to move the third joint member away from a trunk axis of the trunk in a shoulder width direction. The second joint member is rotatable about a second connecting portion between the first joint member and the second joint member, so as to move the third joint member away from the trunk axis in the shoulder width direction.

6 Claims, 6 Drawing Sheets

(56) References Cited

U.S. PATENT DOCUMENTS

| | | | | | |
|---|---|---|---|---|---|
| 4,680,019 | A * | 7/1987 | Baerenwald | A63H 3/46 | 446/378 |
| 4,968,282 | A * | 11/1990 | Robson | A63H 3/46 | 446/376 |
| 5,176,560 | A * | 1/1993 | Wetherell | A63H 3/46 | 446/175 |
| 6,267,640 | B1 * | 7/2001 | Akashi | A63H 3/46 | 446/376 |
| 6,422,916 | B1 * | 7/2002 | Enku | A63H 3/46 | 446/330 |
| 6,494,763 | B1 * | 12/2002 | Hastey | A63H 3/46 | 446/376 |
| 8,308,524 | B2 * | 11/2012 | deFelice | A63H 3/20 | 446/375 |
| 2002/0045401 | A1 | 4/2002 | Enku | | |
| 2005/0112993 | A1 | 5/2005 | Cheng et al. | | |

FOREIGN PATENT DOCUMENTS

| | | | | | |
|---|---|---|---|---|---|
| JP | 2000167257 | A | * | 6/2000 | A63H 3/46 |
| JP | 2009-189498 | A | | 4/2002 | |
| JP | 2009-189498 | A | | 8/2009 | |
| JP | 2009189498 | A | * | 8/2009 | |
| JP | 201136514 | A | * | 2/2011 | |
| JP | 2011036514 | A | * | 2/2011 | |
| JP | 2011041855 | A | * | 3/2011 | |
| JP | 3185443 | U | | 8/2013 | |
| JP | 3187219 | U | | 11/2013 | |

OTHER PUBLICATIONS

European Patent Office, Extended European Search Report for Application No. 16188638.7, dated Mar. 28, 2017, 7 pages, Germany.

* cited by examiner

SHOULDER JOINT STRUCTURE OF DOLL BODY

CROSS REFERENCES TO RELATED APPLICATIONS

The present invention contains subject matter related to Japanese Patent Application No. 2015-209680 filed in the Japan Patent Office on Oct. 26, 2015, the entire contents of which are incorporated herein by reference.

BACKGROUND OF THE INVENTION

1. Field of the Invention

The present invention relates to a shoulder joint structure of a doll body.

2. Description of the Related Art

A shoulder joint structure of a doll body described in Japanese Registered Utility Model No. 3185443 is configured such that a joint member provided at one end of an arm is connected to a shoulder of a trunk through a ring-like cover member made of a soft material. The cover member covers a gap between the shoulder and the arm. When the arm is moved, the cover member is appropriately deformed between the arm and the shoulder, and covers the gap between the shoulder and the arm without limiting the range of motion of the arm.

In the shoulder joint structure of a doll body described in Japanese Registered Utility Model No. 3185443, the position of the shoulder at the base of the arm is almost fixed. For example, when moving the arm in front of the chest of the trunk, the arm abuts on the front or chest side edge of the shoulder of the trunk, and the arm cannot be moved such that the arm overlaps the chest of the trunk. If the shoulder of the trunk is hollowed out to expand the range of motion of the arm, the cover member becomes large and unnaturalness stands out.

SUMMARY OF THE INVENTION

The present invention has been made in consideration of such circumstances, and an object of the present invention is to provide a shoulder joint structure of a doll body the range of arm motion of which can be expanded.

In an aspect of the present invention, a shoulder joint structure of a doll body includes a first joint member housed inside a trunk of the doll body and connected to the trunk, a second joint member housed inside the trunk and connected to the first joint member, and a third joint member connected to the second joint member and an arm of the doll body through an opening formed in a shoulder of the trunk. The first joint member is capable of rotating about a first connecting portion where the trunk and the first joint member are connected, so as to move the third joint member away from a trunk axis of the trunk in a shoulder width direction. The second joint member is capable of rotating about a second connecting portion where the first joint member and the second joint member are connected, so as to move the third joint member away from the trunk axis in the shoulder width direction.

The first joint member may be capable of rotating about the first connecting portion, so as to move the second joint member and the third joint member in front of the trunk in a chest depth direction.

The first connecting portion may be a ball joint.

The first connecting portion may be disposed below the opening of the shoulder of the trunk in an axial direction of the trunk axis.

The first connecting portion may be disposed in front of the opening of the shoulder of the trunk in the chest depth direction.

The first connecting portion may be disposed inside a breast or a pectoralis major muscle of the doll body.

The shoulder joint structure of a doll body may further include an annular cover member that is inserted into the opening of the shoulder of the trunk so as to be protrudable and retractable and that covers the third joint member.

The present invention can provide a shoulder joint structure of a doll body the range of arm rotation of which can be expanded.

DESCRIPTION OF THE PREFERRED EMBODIMENTS

Figure 1:
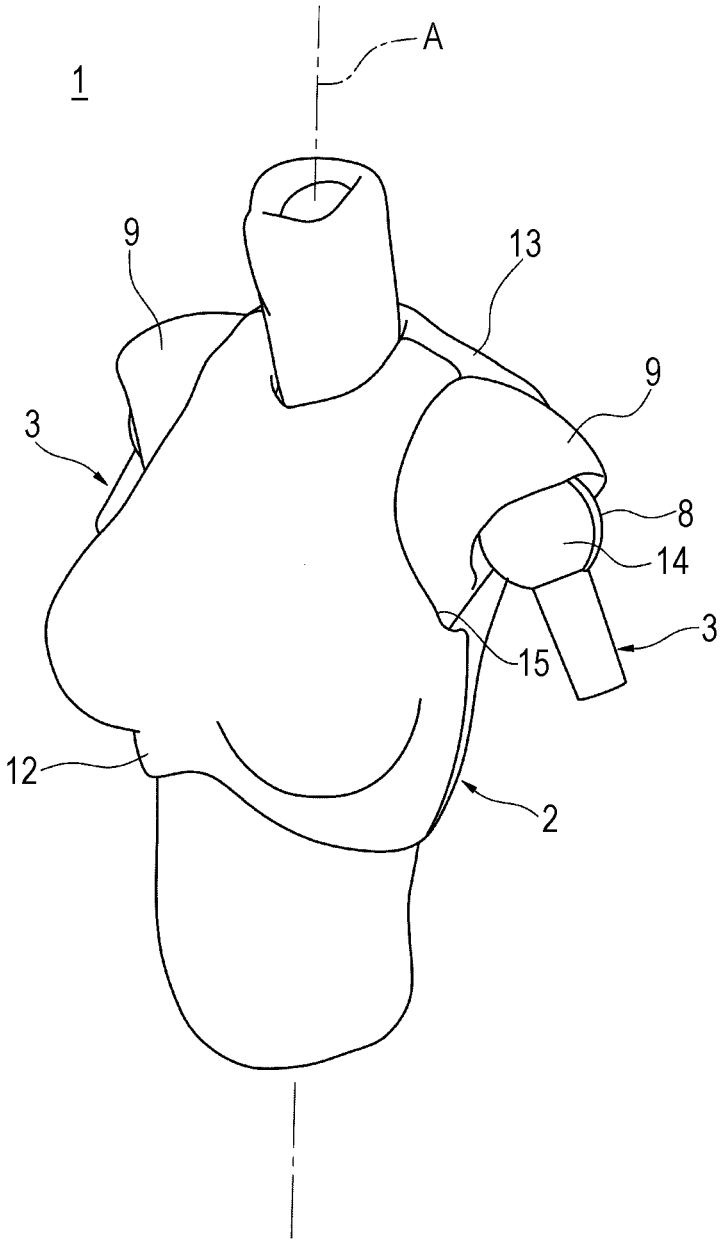
FIG. 1 is a perspective view of the upper body of a doll body for illustrating an embodiment of the present invention.
Figure 2:
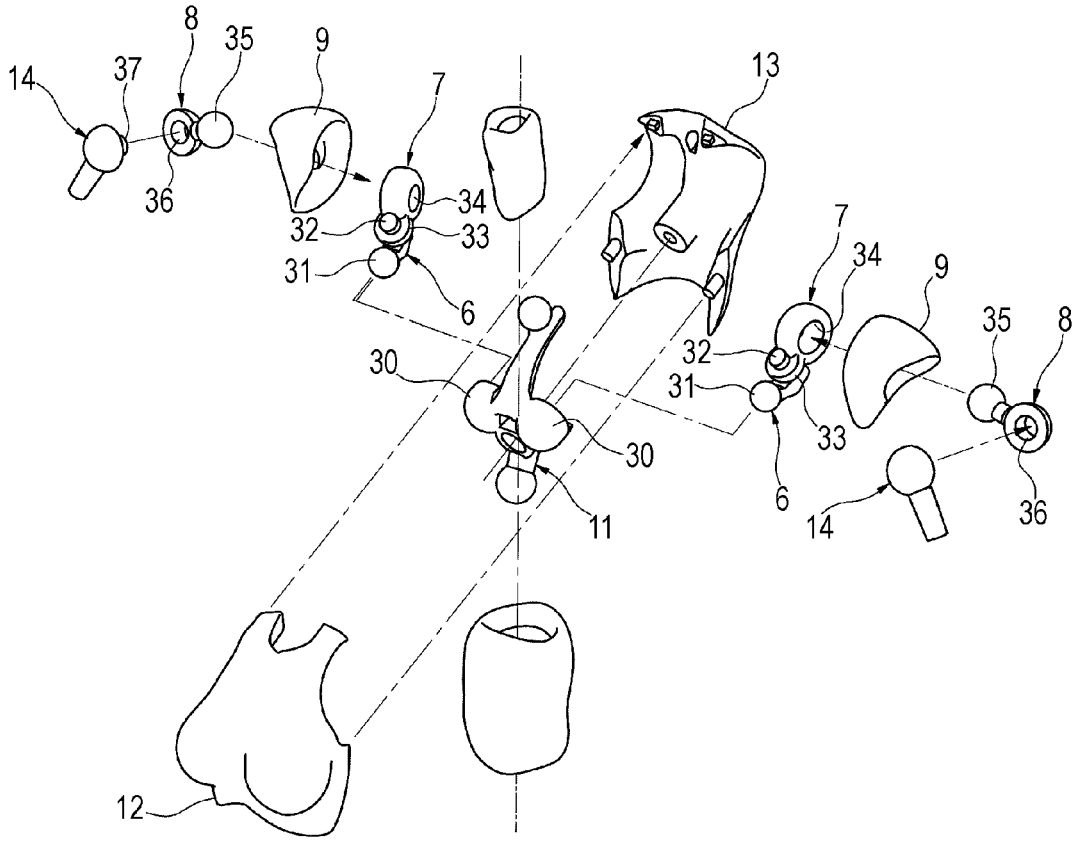
FIG. 2 is an exploded perspective view of the upper body of the doll body of FIG. 1.

FIG. 1 and FIG. 2 show the configuration of the upper body of a doll body for illustrating an embodiment of the present invention.

The doll body 1 shown in FIG. 1 includes a trunk 2 and a pair of left and right arms 3. The pair of left and right arms 3 are each provided with a first joint member 6, a second joint member 7, and a third joint member 8 that form a shoulder joint, and a cover member 9.

The trunk 2 includes a frame member 11 disposed on the trunk axis A of the trunk 2, a chest member 12, and a back member 13. The chest member 12 and the back member 13 are assembled together. The frame member 11 is housed in the inside space of the trunk 2 surrounded by the chest member 12 and the back member 13. The back member 13 is fixed to the frame member 11 with a screw or the like, and the chest member 12 assembled to the back member 13 is also fixed to the frame member 11.

Each arm 3 includes a shoulder member 14 serving as the base of an upper arm. Members (not shown) that form parts beyond the shoulder, such as an upper arm and a forearm, are assembled to the shoulder member 14.

The first joint member 6 and the second joint member 7 are housed inside the trunk 2. The first joint member 6 is connected to the frame member 11 inside the trunk 2, and the second joint member 7 is connected to the first joint member 6.

The third joint member 8 is connected to the shoulder member 14 of the arm 3. An opening 15 is formed in each shoulder of the trunk 2, and the third joint member 8 is connected through the opening 15 to the second joint member 7.

The cover member 9 is formed in an annular shape, and is inserted into the opening 15 of the shoulder of the trunk 2 so as to be protrudable and retractable. The third joint member 8 connected through the opening 15 to the second joint member 7 and the shoulder member 14 is passed through the cover member 9, and the cover member 9 covers the connecting portion between the third joint member 8 and the shoulder member 14.

Figure 3:
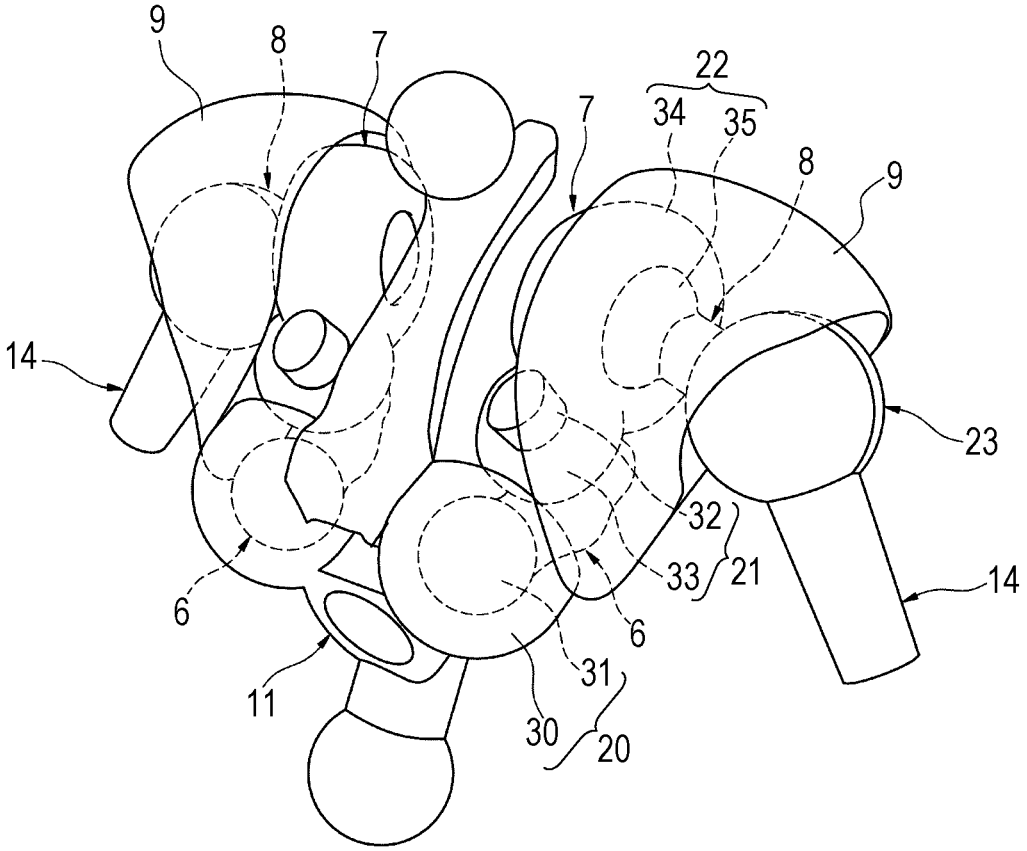
FIG. 3 is a perspective view of a shoulder joint structure of the doll body of FIG. 1.
Figure 4:
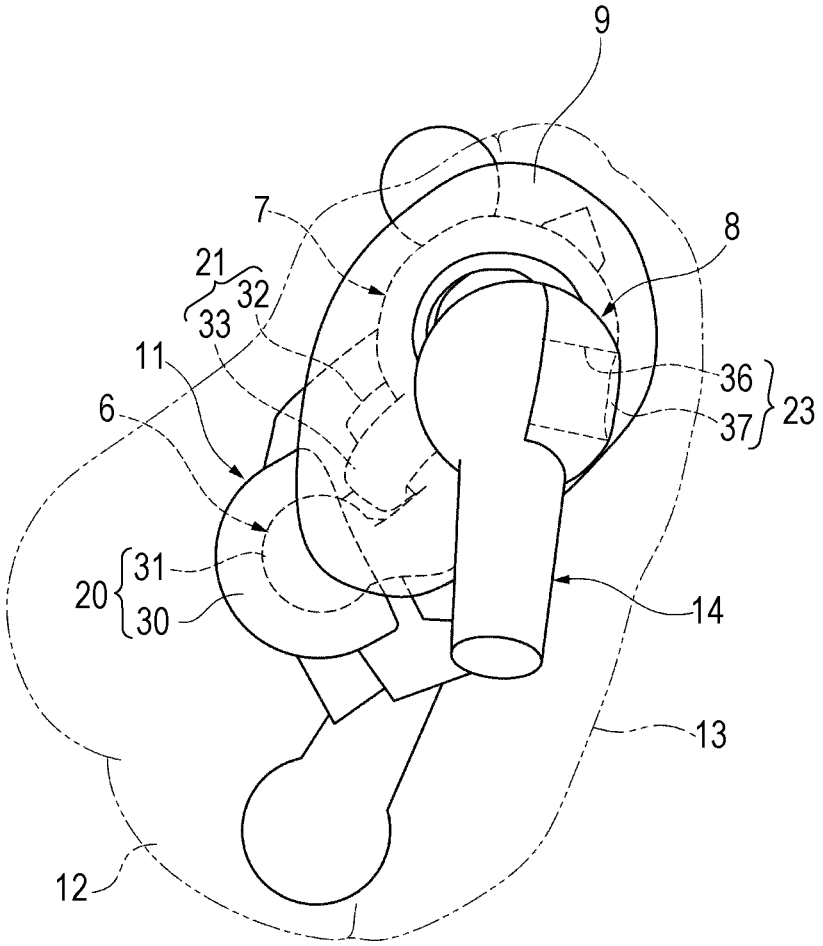
FIG. 4 is a side view of the shoulder joint structure of the doll body of FIG. 1.
Figure 5:
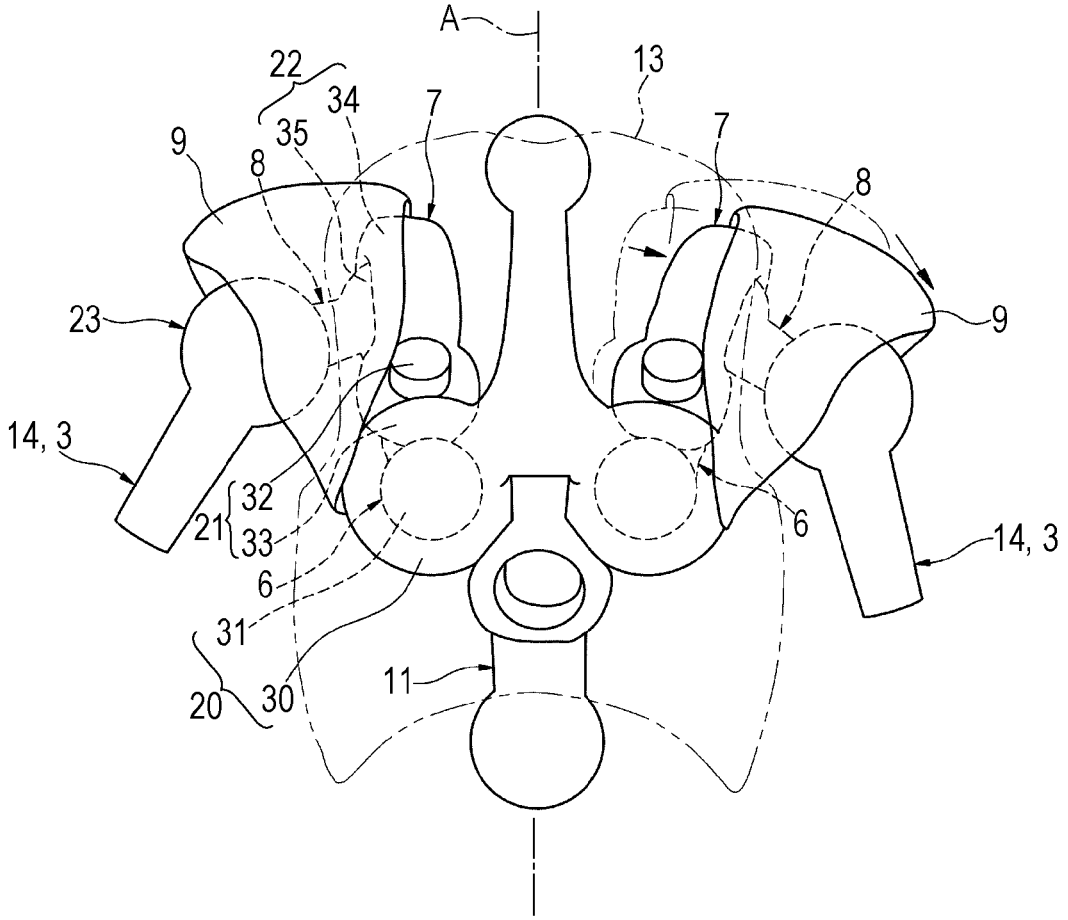
FIG. 5 is a front view showing the operation of the shoulder joint structure of the doll body of FIG. 1.
Figure 6:
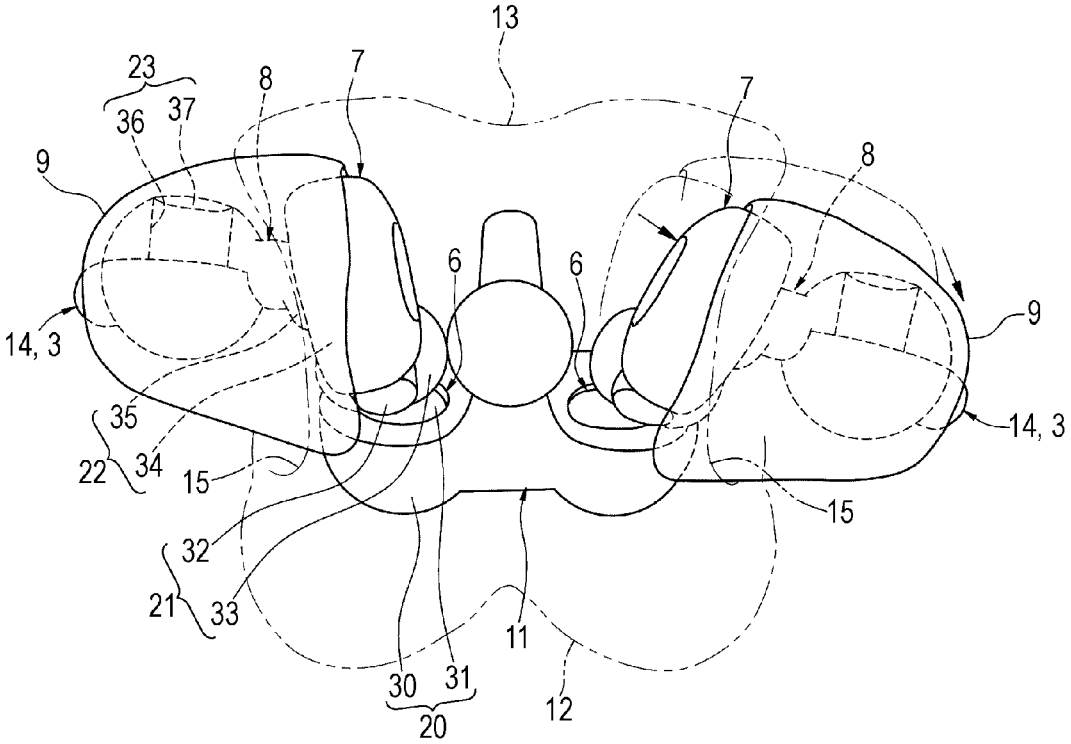
FIG. 6 is a plan view showing the operation of the shoulder joint structure of the doll body of FIG. 1.

FIG. 3 and FIG. 4 show a shoulder joint structure of the doll body 1, and FIG. 5 and FIG. 6 show the operation of the shoulder joint structure of the doll body 1.

The connecting portion 20 between the frame member 11 and the first joint member 6 is disposed below the opening 15 (see FIG. 1) of the shoulder of the trunk 2 in the axial direction of the trunk axis A, and in front of the opening 15 in the chest depth direction. The connecting portion 22 between the second joint member 7 and the third joint member 8 is disposed in the shoulder of the trunk 2 facing the opening 15. The connecting portion 21 between the first joint member 6 and the second joint member 7 is disposed between the connecting portion 20 and the connecting portion 22.

The connecting portion 20 between the frame member 11 and the first joint member 6 is configured as a so-called ball joint consisting of a socket 30 provided in the frame member 11 and a ball 31 provided at one end of the first joint member 6. The first joint member 6 is capable of rotating with respect to the frame member 11 in a precession-like motion. The frame member 11 may be provided with a ball, and the first joint member 6 may be provided with a socket.

The connecting portion 20 between the first joint member 6 and the second joint member 7 consists of a shaft portion 32 provided at the other end of the first joint member 6, and a bearing portion 33 provided at one end of the second joint member 7. The second joint member 7 is capable of rotating with respect to the first joint member 6 about the shaft portion 32. The first joint member 6 may be provided with a bearing portion, and the second joint member 7 may be provided with a shaft portion.

The connecting portion 22 between the second joint member 7 and the third joint member 8 is configured as a so-called ball joint consisting of a socket 34 provided at the other end of the second joint member 7 and a ball 35 provided at one end of the third joint member 8. The third joint member 8 is capable of rotating with respect to the second joint member 7 in a precession-like motion. The second joint member 7 may be provided with a ball, and the third joint member 8 may be provided with a socket.

The connecting portion 23 between the third joint member 8 and the shoulder member 14 of the arm 3 consists of a bearing portion 36 provided at the other end of the third joint member 8 and a shaft portion 37 provided on the shoulder member 14. The shoulder member 14 is capable of rotating with respect to the third joint member 8 about the shaft portion 37. The third joint member 8 may be provided with a shaft portion, and the shoulder member 14 may be provided with a bearing portion.

The arm 3 is swung with respect to the trunk 2 back and forth and up and down by the rotation of the shoulder member 14 relative to the third joint member 8 and the rotation of the third joint member 8 relative to the second joint member 7.

As shown in FIG. 5 and FIG. 6, the first joint member 6 is capable of rotating with respect to the frame member 11 about the connecting portion 20 with the frame member 11, which is configured as a ball joint, so as to move the connecting portion 21 with the second joint member 7 away from the trunk axis A of the trunk 2 in the shoulder width direction. By such rotation of the first joint member 6, the third joint member 8 is moved away from the trunk axis A in the shoulder width direction.

The second joint member 7 is also capable of rotating with respect to the first joint member 6 about the connecting portion 21 with the first joint member 6, so as to move the connecting portion 22 with the third joint member 8 away from the trunk axis A of the trunk 2 in the shoulder width direction. By such rotation of the second joint member 7, the third joint member 8 is moved further away from the trunk axis A in the shoulder width direction.

Since the third joint member 8 is moved away from the trunk axis A in the shoulder width direction, the connecting portion 23 between the third joint member 8 and the shoulder member 14 of the arm 3 moves away from the opening 15 of the shoulder of the trunk 2. Thereby, the upper arm part of the arm 3 extending beyond the shoulder member 14 is made less likely to interfere with the trunk 2 or the edge of the opening 15, and the range of motion of the arm 3 is expanded. For example, when moving the arm 3 in front of the chest of the trunk 2, the arm 3 can be moved such that the arm 3 overlaps the chest of the trunk 2.

The first joint member 6 is capable of rotating with respect to the frame member 11 about the connecting portion 20 with the frame member 11, which is configured as a ball joint, so as to move the third joint member 8 forward in the chest depth direction. By such rotation of the first joint member 6, the connecting portion 23 between the third joint member 8 and the shoulder member 14 of the arm 3, that is, the part about which the arm 3 swings is disposed close to the front edge of the opening 15 of the shoulder of the trunk 2. Thereby, the upper arm portion of the arm 3 extending beyond the shoulder member 14 is made less likely to interfere with the trunk 2 or the front edge of the opening 15, and the range of motion of the arm 3 is further expanded. That is, the range of motion when moving the arm 3 in front of the trunk 2 is expanded.

Since the connecting portion 20, about which the first joint member 6 rotates, is disposed on the front side of the opening 15 in the chest depth direction, the arm 3 can be moved in front of the trunk 2 to a greater extent than in a case where the connecting portion 20 is at the back of the chest in the chest depth direction. Since the connecting portion 20, about which the first joint member 6 rotates, is disposed below the opening 15 of the shoulder of the trunk 2 in the axial direction of the trunk axis A, the radius of rotation of the third joint member 8 can be increased. The first joint member 6 is rotated in a limited space inside the trunk 2, and the rotation angle of the first joint member 6 is naturally limited. However, since the radius of rotation of the third joint member 8 is increased, the amount of displacement of the third joint member 8 can be increased despite the predetermined rotation angle of the first joint member 6.

If the connecting portion 20, about which the first joint member 6 rotates, is provided above the opening 15 of the shoulder of the trunk 2 in the axial direction of the trunk axis A, the upper part of the trunk 2 (the position near the collarbone in a human body) becomes thick in the chest depth direction in order to secure a space for the connecting portion 20, and therefore the appearance is impaired. By disposing the connecting portion 20, about which the first joint member 6 rotates, in the chest of the trunk 2, a space for housing the connecting portion 20 can be secured inside the breast, utilizing the swell of the breast, without providing the appearance of the trunk 2 with an unnatural bulge.

During the movement of the third joint member 8, the cover member 9 is dragged by the third joint member 8 and protrudes from the opening 15 of the shoulder of the trunk 2, or comes into contact with the third joint member 8 and is thereby retracted into the opening 15, and a state where the connecting portion 23 between the third joint member 8 and the shoulder member 14 is covered by the cover member 9 is maintained. Thereby, the naturalness of appearance can be kept while expanding the range of motion of the arm 3 of the doll body 1.

Although in the embodiment of the present invention described above, the connection between the first joint member 6 and the frame member 11 and the connection between the second joint member 7 and the third joint member 8 are ball joints, and the connection between the first joint member 6 and the second joint member 7 and the connection between the third joint member 8 and the shoulder member 14 are shaft and bearing joints, the structures of the connecting portions of the shoulder joint structure of the present invention are not limited to those set forth above.

What is claimed is:

1. A shoulder joint structure of a doll body, comprising:

a first joint member housed inside a trunk of the doll body and connected to the trunk;

a second joint member housed inside the trunk and connected to the first joint member; and a third joint member connected to the second joint member and an arm of the doll body through an opening formed in a shoulder of the trunk, wherein the first joint member is capable of rotating about a first connecting portion where the trunk and the first joint member are connected, so as to move the third joint member away from a trunk axis of the trunk in a shoulder width direction, wherein the first connecting portion is disposed in front of the opening of the shoulder of the trunk in a chest depth direction, and wherein the second joint member is capable of rotating about a second connecting portion where the first joint member and the second joint member are connected, so as to move the third joint member away from the trunk axis in the shoulder width direction.

2. The shoulder joint structure of a doll body according to claim 1, wherein the first joint member is capable of rotating about the first connecting portion, so as to move the second joint member and the third joint member in front of the trunk in a chest depth direction.

3. The shoulder joint structure of a doll body according to claim 2, wherein the first connecting portion comprises a ball joint.

4. The shoulder joint structure of a doll body according to claim 1, wherein the first connecting portion is disposed below the opening of the shoulder of the trunk in an axial direction of the trunk axis.

5. The shoulder joint structure of a doll body according to claim 1, wherein the first connecting portion is disposed inside a breast or a pectoralis major muscle of the doll body.

6. The shoulder joint structure of a doll body according to claim 1, further comprising an annular cover member that is inserted into the opening of the shoulder of the trunk so as to be protrudable and retractable and that covers the third joint member.

* * * * *